US011345147B2

(12) United States Patent
Kato

(10) Patent No.: US 11,345,147 B2
(45) Date of Patent: May 31, 2022

(54) LIQUID EJECTION HEAD

(71) Applicant: CANON KABUSHIKI KAISHA, Tokyo (JP)

(72) Inventor: Masataka Kato, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 16/592,629

(22) Filed: Oct. 3, 2019

(65) Prior Publication Data

US 2020/0122464 A1 Apr. 23, 2020

(30) Foreign Application Priority Data

Oct. 19, 2018 (JP) ..... JP2018-197291
Sep. 17, 2019 (JP) ..... JP2019-168862

(51) Int. Cl.
*B41J 2/14* (2006.01)
*B41J 2/335* (2006.01)

(52) U.S. Cl.
CPC ..... *B41J 2/14032* (2013.01); *B41J 2/33535* (2013.01); *B41J 2002/14491* (2013.01)

(58) Field of Classification Search
CPC ..... B41J 2/14032; B41J 2/14016; B41J 2/14145; B41J 2/14072; B41J 2/1433; B41J 2/33535; B41J 2002/14491
See application file for complete search history.

(56) References Cited

U.S. PATENT DOCUMENTS

2012/0033017 A1* 2/2012 Iwanaga ..... B41J 2/1623 347/54
2014/0132674 A1* 5/2014 Takeuchi ..... B41J 2/14072 347/47
2016/0128175 A1* 5/2016 Kobayashi ..... B41J 2/14072 347/50
2016/0144624 A1* 5/2016 Gejima ..... B41J 2/14201 347/71
2017/0368825 A1* 12/2017 Tanaka ..... B41J 2/14233

FOREIGN PATENT DOCUMENTS

JP 2006-27109 A 2/2006

* cited by examiner

*Primary Examiner* — Scott A Richmond
(74) *Attorney, Agent, or Firm* — Canon U.S.A., Inc. I.P. Division

(57) ABSTRACT

A liquid ejection head includes a recording element substrate including an ejection port member including a liquid ejection port, an electrical wiring layer including a pressure generating element that pressurizes the liquid to eject the liquid and an electrically connecting part connected to the pressure generating element to supply power for driving the pressure generating element to the pressure generating element, and a silicon substrate having the ejection port member and the electrical wiring layer. The silicon substrate includes a through-hole passing through the silicon substrate to expose the electrically connecting part. An outer shape of an opening of the through-hole on the back side of the silicon substrate has no side parallel to direction [110] of the silicon substrate or has a side parallel to the direction [110]. The side has a length equal to or less than half an entire length of the through-hole in the direction [110].

12 Claims, 10 Drawing Sheets

FIG. 4A1
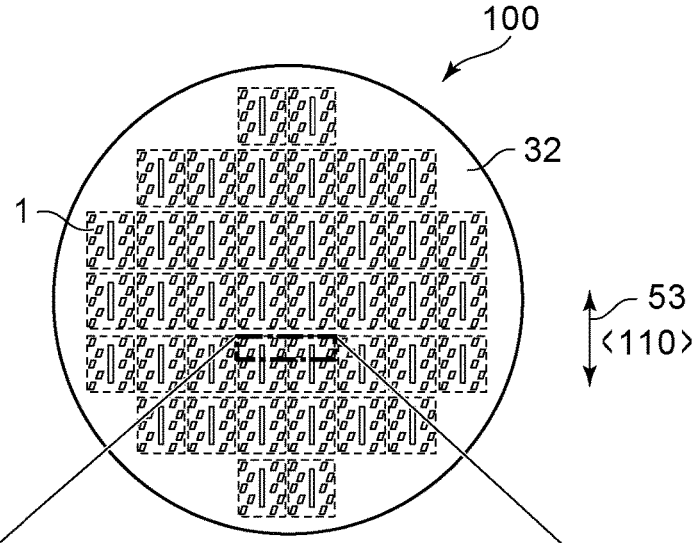
FIG. 4A2
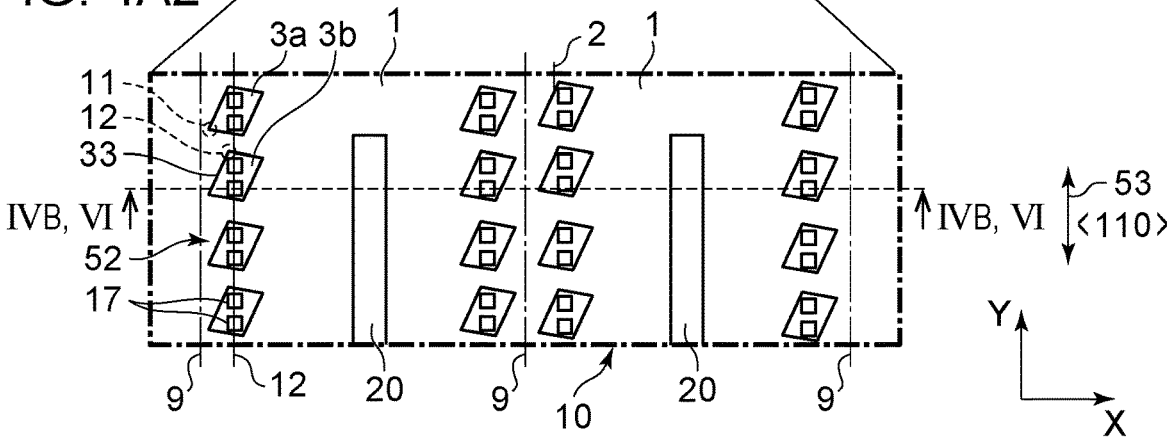
FIG. 4B
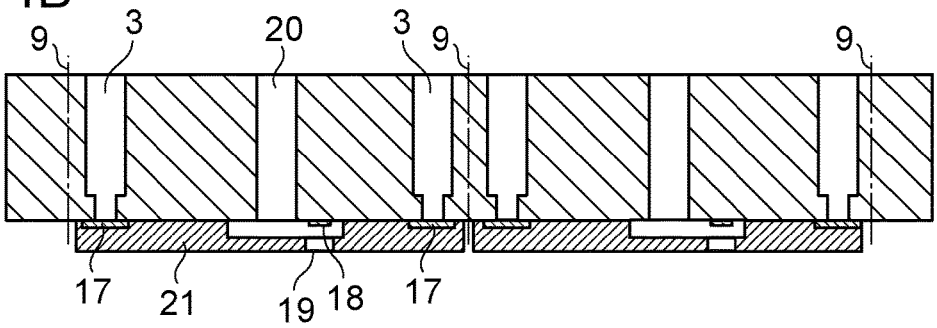
FIG. 4C
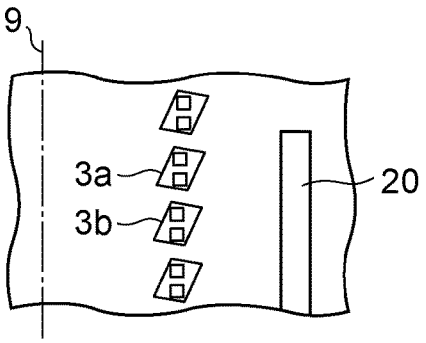

LIQUID EJECTION HEAD

BACKGROUND OF THE INVENTION

Field of the Invention

The present disclosure relates to a liquid ejection head.

Description of the Related Art

A recording element substrate that ejects liquid includes, on a surface having a liquid ejection port, an electrically connecting part for supplying power from an external power source to a pressure generating element for pressurizing liquid. However, in the case where the electrically connecting part is provided on the ejection port side, the mist or the like of liquid ejected through the ejection port may attach to the electrically connecting part to possibly cause corrosion of the electrically connecting part.

For this reason, the electrically connecting part may be disposed away from the ejection port area. Japanese Patent Laid-Open No. 2006-27109 discloses a method of forming electrically connecting parts on the back of the ejection port side. The method requires boring a plurality of through-holes from the back of a surface of the silicon substrate joined to an ejection port member having the ejection ports to provide the electrically connecting parts on the back of the ejection port side.

A general silicon substrate for use in a recording element substrate has a surface (100) on the front side. It is known that the silicon substrate having the surface (100) on its front side is prone to crack in a direction [110]. Accordingly, if a plurality of through-holes bored from the back of the silicon substrate are arrayed in the direction [110], an external force or the like applied to the silicon substrate can crack the silicon substrate, damaging the recording element substrate.

SUMMARY OF THE INVENTION

The present disclosure provides a liquid ejection head in which cracking of a recording element substrate in which a plurality of through-holes are formed on the back side is suppressed.

A liquid ejection head according to an aspect of the present disclosure includes a recording element substrate. The recording element substrate includes an ejection port member including an ejection port that ejects liquid, an electrical wiring layer including a pressure generating element configured to pressurize the liquid to eject the liquid and an electrically connecting part connected to the pressure generating element through an electrical wiring line to supply power for driving the pressure generating element to the pressure generating element, and a silicon substrate having the ejection port member and the electrical wiring layer on a front side. A back side of the silicon substrate is a surface (100). The silicon substrate includes at least one through-hole passing through the silicon substrate to expose the electrically connecting part. An outer shape of an opening of the through-hole on the back side of the silicon substrate has no side parallel to direction [110] of the silicon substrate or has a side parallel to the direction [110] of the silicon substrate. The side has a length equal to or less than half an entire length of the through-hole in the direction [110].

Further features of the present disclosure will become apparent from the following description of exemplary embodiments with reference to the attached drawings.

BRIEF DESCRIPTION OF THE DRAWINGS

FIGS. 4A1 to 4C are schematic diagrams illustrating silicon substrates according to a first embodiment of the present disclosure.

DESCRIPTION OF THE EMBODIMENTS

Liquid ejection heads according to embodiments of the present disclosure and a method for manufacturing the same will be described hereinbelow with reference to the drawings. However, the following description is not intended to limit the scope of the present disclosure. Although the present embodiments employ a thermal method for generating air bubbles with a heating element to eject liquid as a liquid ejection head, the present disclosure can also be applied to a liquid ejection head that uses a piezoelectric method or other various liquid ejection methods. Although the liquid ejection heads of the present embodiments are so-called PageWide heads with a length corresponding to the width of the printing medium, the present disclosure may also be applied to a so-called serial liquid ejection head that records while scanning the printing medium. An example configuration of the serial liquid ejection head is a configuration including one black ink recording element substrate and one color ink recording element substrate.

First Embodiment

Liquid Ejection Head

Figure 1:
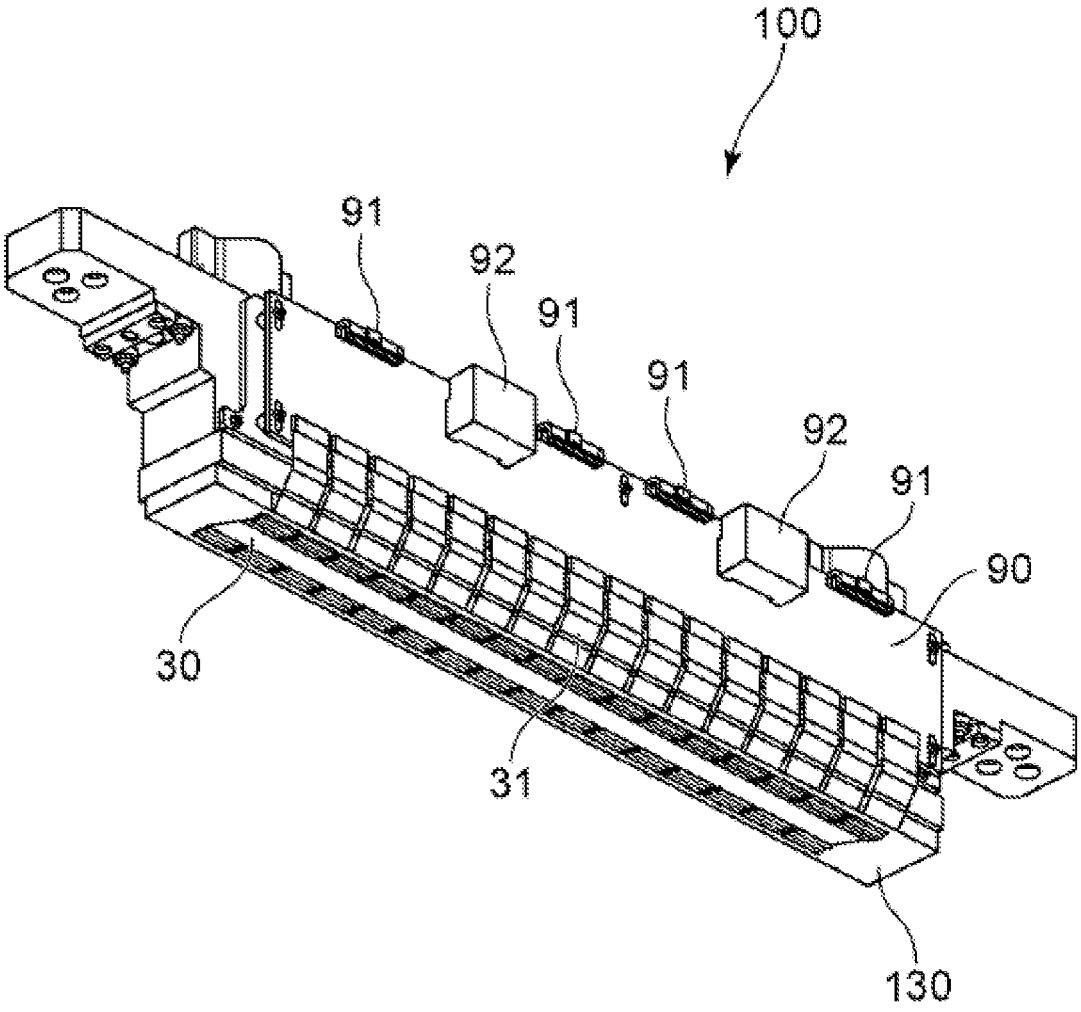
FIG. 1 is a perspective view of a liquid ejection head according to an embodiment of the present disclosure.

A liquid ejection head according to the present embodiment will be described with reference to FIG. 1. FIG. 1 is a perspective view of a liquid ejection head 100 according to the present embodiment. The liquid ejection head 100 of the present embodiment is a PageWide liquid ejection head in which 16 recording element substrates 30 capable of ejecting cyan (C), magenta (M), yellow (Y), and black (K) inks are arrayed in a straight line (disposed in a line). The liquid ejection head 100 includes the recording element substrates 30, flexible electrical wiring members 31, a plate-like electrical wiring substrate 90, signal input terminals 91, and power supply terminals 92. The signal input terminals 91 and the power supply terminals 92 are electrically connected to a conveying unit (not illustrated) that conveys printing media (not illustrated) and a control unit of a recording apparatus main body (not illustrated) including the liquid ejection head 100 to supply an ejection drive signal and power necessary for ejection to the recording element substrate 30 via the electrical wiring member 31. An example of the electrical wiring member 31 is a flexible printed circuit (FPC) board. By integrating the wires using the electrical circuit of the electrical wiring substrate 90, the number of the signal input terminals 91 and the power supply terminals 92 can be made smaller than that of the recording element substrate 30. This reduces the number of electrically connecting parts that have to be or attached or detached in attaching or detaching the liquid ejection head 100.

Although FIG. 1 illustrates a PageWide liquid ejection head in which the recording element substrates 30 are disposed in a straight line in the longitudinal direction of the liquid ejection head, this is given for illustrative purpose only and is not intended to limit the present disclosure. A PageWide liquid ejection head in which the recording element substrates 30 are disposed in a staggered pattern in the longitudinal direction may be used.

Recording Element Substrate

Figure 2A:
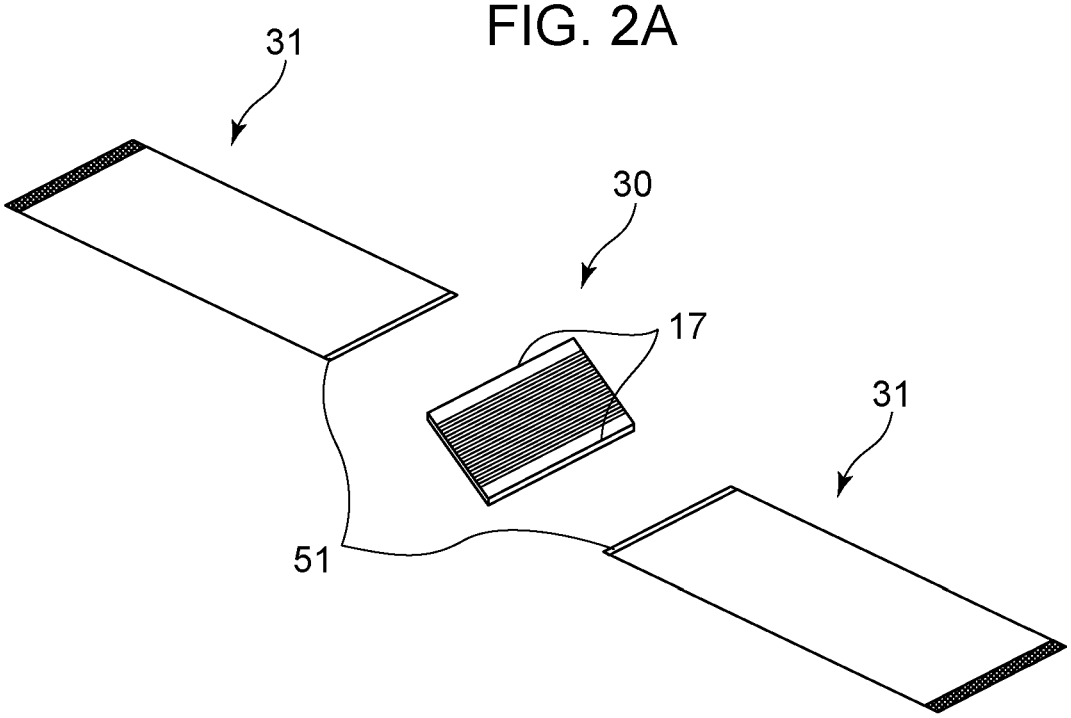
FIGS. 2A and 2B are perspective views of a recording element substrate and electrical wiring members.
Figure 2B:
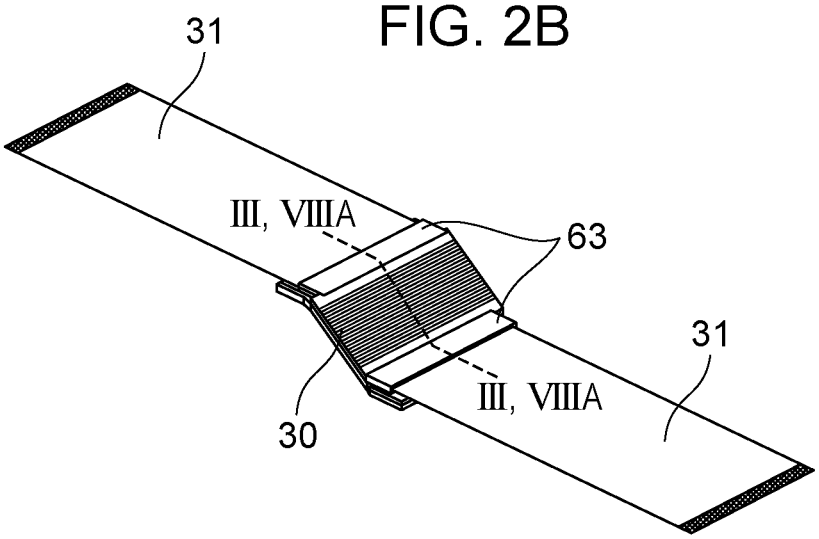

Referring to FIGS. 2A and 2B to FIGS. 4A1 to 4C, the recording element substrate 30, which is a feature of the present disclosure, will be described. First, the electrical connection of the recording element substrates 30 and the electrical wiring members 31 will be described with reference to FIGS. 2A and 2B. FIGS. 2A and 2B are perspective views of one of the plurality of recording element substrates 30 and two of the plurality of electrical wiring members 31 of the liquid ejection head 100, illustrating the back of a surface on which the ejection port of the recording element substrate 30 is provided (hereinafter referred to as "back side"). FIG. 2A is a perspective view of the recording element substrate 30 and the electrical wiring members 31 illustrating a state before electrical connection. FIG. 2B is a perspective view after the recording element substrate 30 and the electrical wiring members 31 are electrically connected.

Figure 3:
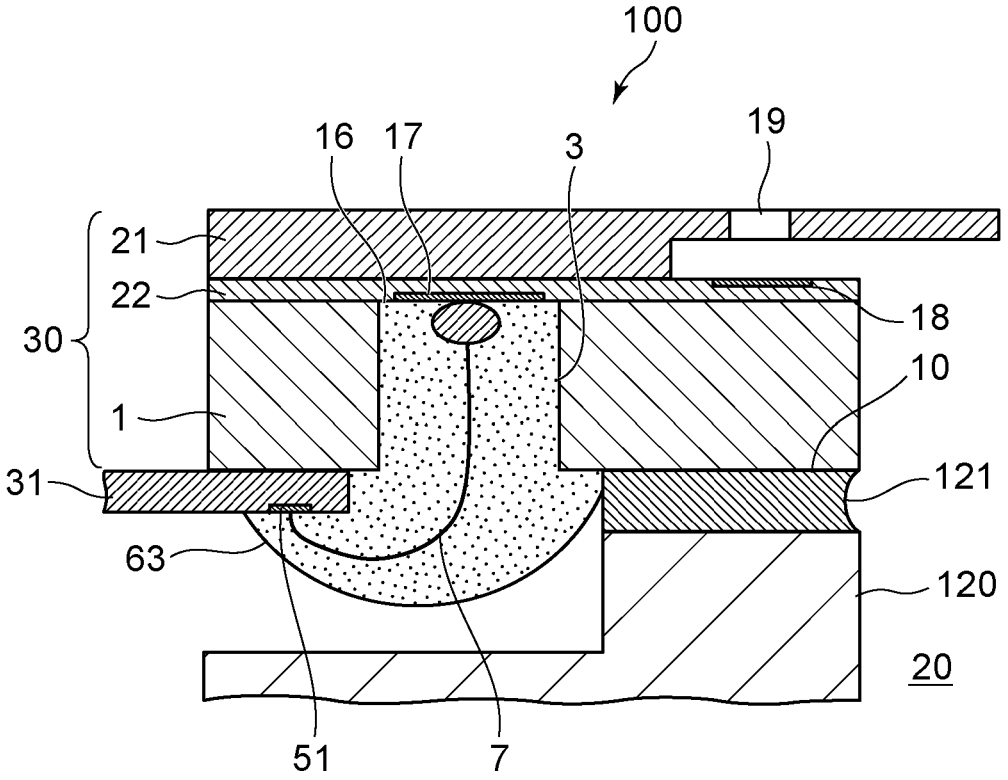
FIG. 3 is a schematic diagram illustrating the configuration of electrical connection.

In the present embodiment, electrically connecting parts 17 formed on the back side of the recording element substrate 30 and terminals 51 of the electrical wiring members 31 are each electrically connected using a metal wire 7 (FIG. 3), as illustrated in FIG. 2B. Each electrically connecting part 17 is covered by a sealing member 63. Part of the sealing member 63 fills a through-hole 3 (FIG. 3). In the present embodiment, the recording element substrate 30 and the electrical wiring members 31 are connected into one module, as illustrated in FIG. 2B, and a total of 16 modules are arrayed to constitute the PageWide liquid ejection head 100. Such a module configuration allows providing a liquid ejection head of a necessary length by changing the number of modules mounted as appropriate.

Referring next to FIG. 3, the configuration of the recording element substrate 30 will be described in detail. FIG. 3 is a schematic cross-sectional view taken along line III-III of FIG. 2B. FIG. 3 illustrates a channel member 120 for illustrative purpose, although FIG. 2B does not illustrate the channel member 120. The electrical wiring member 31 is placed on the back side of the silicon substrate 1. The terminal 51 of the electrical wiring member 31 and the electrically connecting part 17 of the recording element substrate 30 are electrically connected by so-called wire bonding. The recording element substrate 30 is in close-contact with a channel member 120, with a sealing member 121 therebetween. Ink is supplied to an ejection port 19 through a liquid supply port 20 formed by a channel member 120.

As illustrated in FIG. 3, the recording element substrate 30 includes the silicon substrate 1, an electrical wiring layer 22, and an ejection port member 21. The recording element substrate 30 has the liquid supply port 20. The ink supplied through the liquid supply port 20 is pressurized by a pressure generating element 18 and ejected through the ejection port 19. In the present embodiment, the pressure generating element 18 is a heater that generates thermal energy and heats the ink to generate air bubbles therein to eject ink using the sparkling pressure of the air bubbles. The pressure generating element 18 is electrically connected to the electrically connecting part 17 through the electrical wiring layer 22. The electrically connecting part 17 is connected to an external power source for the recording element substrate 30, whereby power for driving the pressure generating element 18 is supplied to the pressure generating element 18. The through-hole 3 is formed on the back side of the silicon substrate 1 by so-called dry etching. The electrically connecting part 17 is located on the bottom 16 of the through-hole 3. Thus, the through-hole 3 exposes the electrically connecting part 17. The pressure generating element 18 and the electrically connecting part 17 constitute the electrical wiring layer 22. As illustrated in FIG. 3, the silicon substrate 1 has the ejection port member 21 and the electrical wiring layer 22 on its front surface.

Although the through-hole 3 in the recording element substrate 30 (FIG. 4B) and the through-hole 3 in FIG. 3 have different shapes, the present disclosure is applicable to either shape. The shape in FIG. 3 is more simplified than the shape in the recording element substrate 30 of FIG. 4B for illustrative purpose only.

Referring next to FIGS. 4A1 to 4C, the through-hole 3 in the recording element substrate 30, which is a relevant part of the present disclosure, will be described. FIG. 4A1 is a diagram of an wafer 32 on which a plurality of recording element substrates 30 are formed, and FIG. 4A2 is an enlarged view of part of the wafer. As illustrated in FIG. 4A1, the silicon substrate 1 for use in the recording element substrate 30 has a rectangular outer shape having sides parallel to a direction [110] and sides perpendicular to the parallel sides. A first through-hole 3*a* and a second through-hole 3*b* are disposed on a straight line 12 extending in the direction [110], as illustrated in FIG. 4A1. FIG. 4B is a diagram illustrating a IVB-IVB cross section of the wafer 32 in FIG. 4A2. In the present disclosure, the wafer 32 having a surface (100) in crystal orientation is used so that the crystal orientation of the back side of the silicon substrate 1 is the surface (100). A silicon substrate having the surface (100) on its front surface is prone to cracking in the direction [110] indicated by arrow 53. Accordingly, if the through-hole 3 has a side parallel to the direction [110], the silicon substrate 1 tends to crack from the parallel side of the through-hole 3 in the direction [110], which will be described in detail below with reference to FIG. 10.

As illustrated in FIG. 4A2, the opening 52 of the through-hole 3 in the present embodiment has at least sides inclined with respect to the direction [110], for example, sides 33. In particular, since the through-hole 3 of the present embodiment has not a side extending in the direction [110], which serves as a crack starting point, cracking of the silicon substrate 1 in the direction [110] is suppressed. Even if a crack 2 occurs from above in the plane of FIG. 4A2 toward the silicon substrate 1, the advancing crack 2 stops at the through-hole 3 because the through-hole 3 has no side extending in the direction [110], which is the advancing direction of the crack 2. Accordingly, even if a crack occurs, the through-hole 3 of the present embodiment can suppress the advance of the crack at the position of the through-hole 3.

Furthermore, an end 11 of the first through-hole 3*a* and an end 12 of the second through-hole 3*b* of the through-hole 3 in the present embodiment differ in the X-direction perpendicular to the direction [110]. Thus, even if a crack occurs from the end 11, propagation of the crack to the end 12 of the second through-hole 3*b* closest to the end 11 can be suppressed.

Although the through-holes 3 in FIGS. 4A1 to 4C are disposed along dicing lines 9, that is, along an end of the recording element substrate 30, this is not intended to limit the present embodiment. For example, the through-holes 3 may be disposed between each dicing line 9 and each liquid supply port 20 (FIG. 4C). This also provides the same advantageous effects as those of the silicon substrate 1 in FIGS. 4A1 and 4A2. Having described the silicon substrate 1 whose outer shape is rectangular, as illustrated in FIG. 4A1, the present disclosure may use a silicon substrate whose outer shape is a parallelogram. In other words, the outer shape of the silicon substrate 1 may be a parallelogram having sides inclined with respect to the direction [110].

Comparative Example

Figure 10:
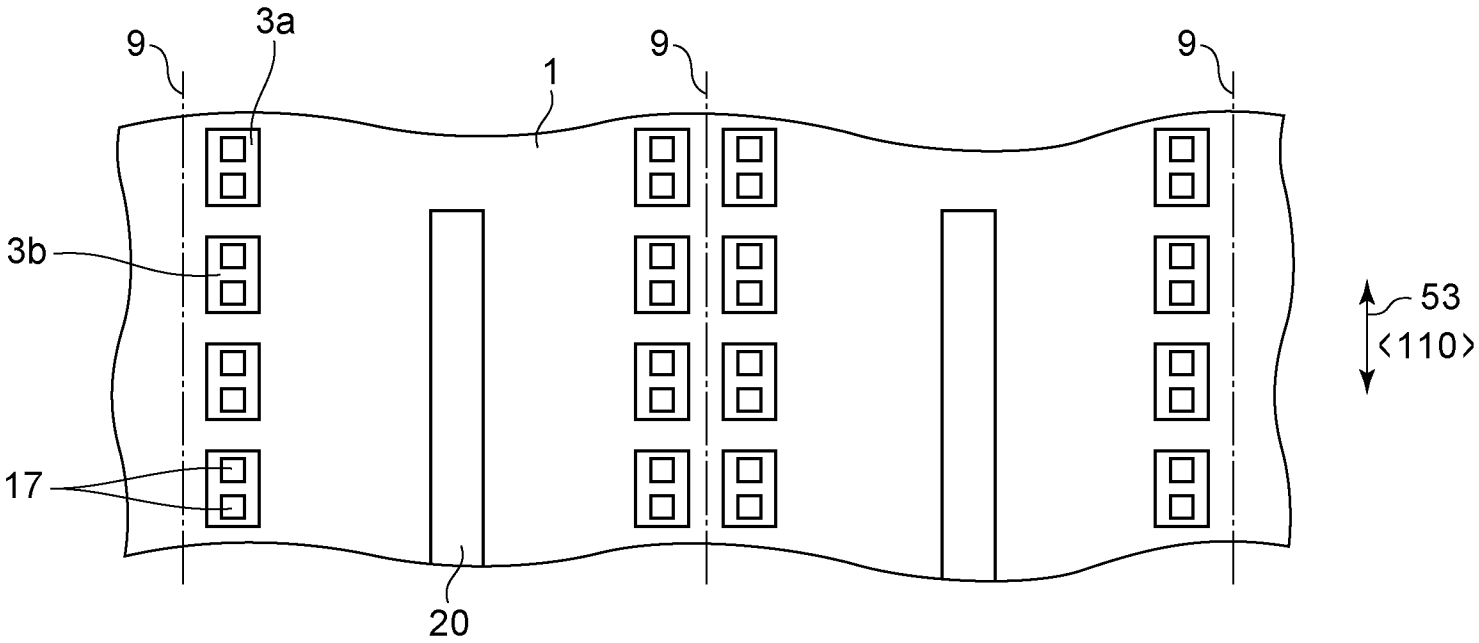
FIG. 10 is a schematic diagram illustrating a silicon substrate according to a comparative example.

A comparative example of the present disclosure will be described with reference to FIG. 10. FIG. 10 is a schematic diagram illustrating a silicon substrate according to the comparative example. The difference between the silicon substrate 1 of the comparative example and the silicon substrate 1 according to an embodiment of the present disclosure is that the through-hole 3 has sides parallel to the direction [110]. This makes the silicon substrate 1 prone to cracking in the direction [110] from the sides parallel to the direction [110] of the through-hole 3.

In contrast, since the through-hole 3 of the present embodiment has sides inclined with respect to the direction [110] and no sides extending in the direction [110], thus having no sides serving as cracking start points. This suppresses cracking of the silicon substrate 1 in the direction [110].

Method for Manufacturing Liquid Ejection Head

Figure 5:
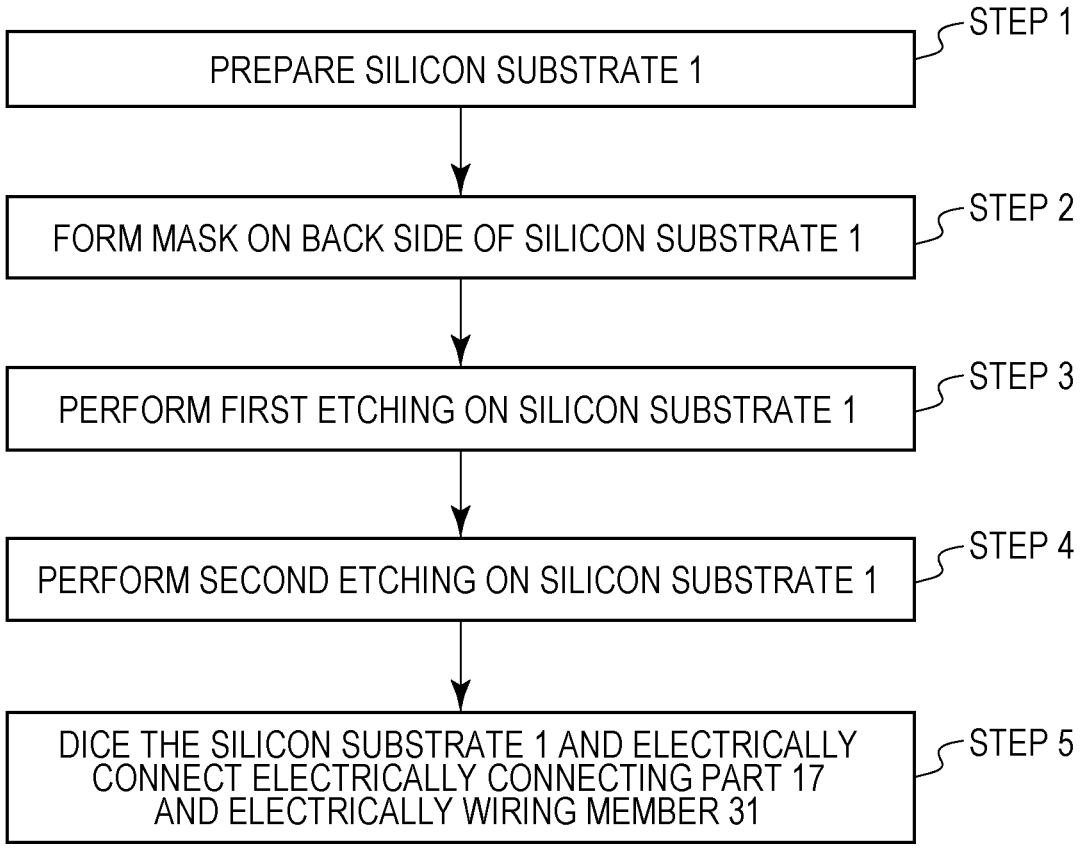
FIG. 5 is a flowchart of liquid ejection head manufacturing steps.

A method for manufacturing the liquid ejection head according to the present embodiment will be described with reference to FIG. 5 and FIGS. 6A to 6E. FIG. 5 is a flowchart illustrating the manufacturing steps. FIGS. 6A to 6E are schematic cross-sectional views of the recording element substrate 30 taken along line VIE-VIE of FIG. 4A2 corresponding to the manufacturing steps illustrated in FIG. 5.

Figure 6A:
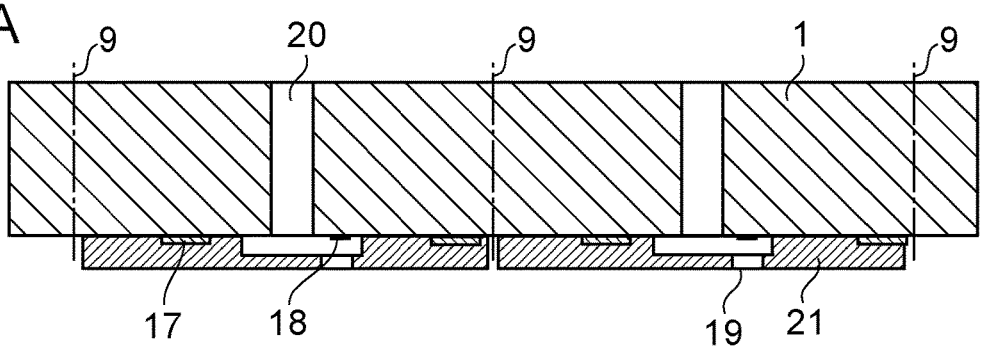
FIGS. 6A to 6E are schematic diagrams illustrating the liquid ejection head manufacturing steps.
Figure 6B:
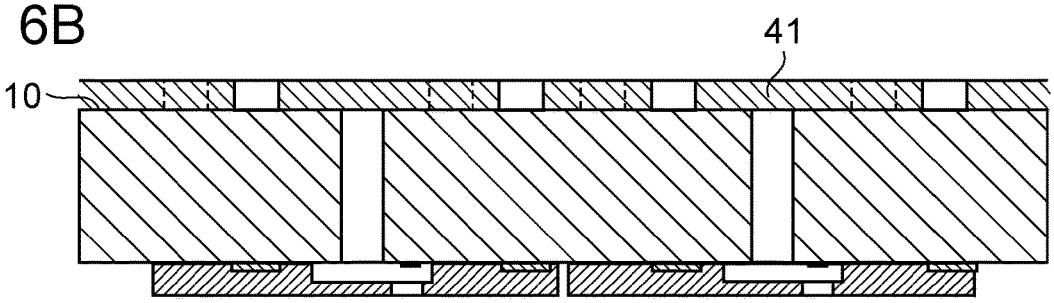
Figure 6C:
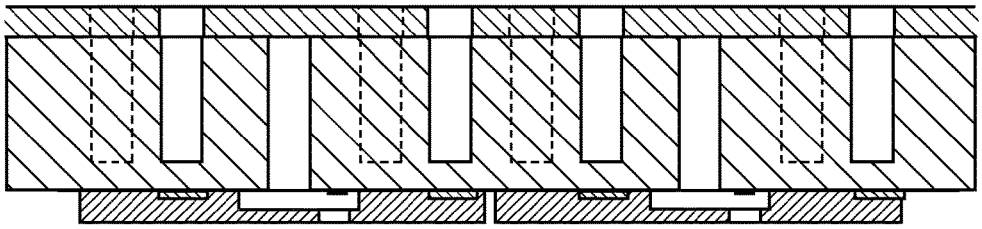
Figure 6D:
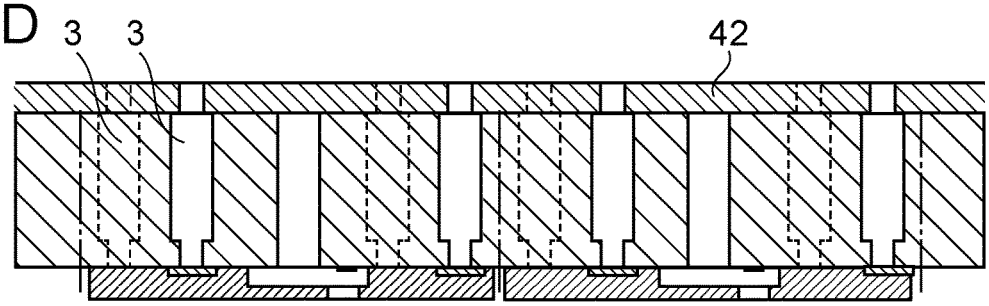
Figure 6E:
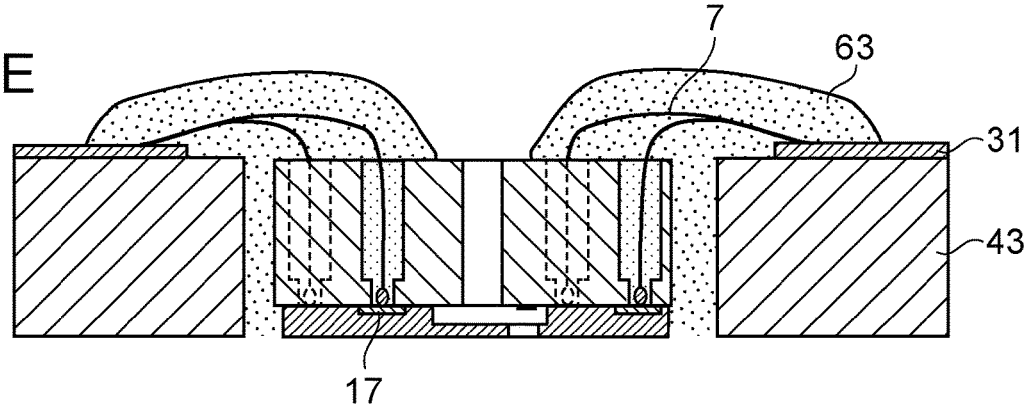

First, the silicon substrate 1 on which the ejection port member 21 and so on are provided is prepared (Step 1 in FIG. 5, FIG. 6A). Next, a mask of a tenting resist 41 is formed on the back side 10 of the silicon substrate 1 by patterning (Step 2 in FIG. 5, FIG. 6B). Next, holes for electrical connection are bored by reactive ion etching (RIE) using the tenting resist 41 as a mask. At that time, the silicon substrate 1 may be passed through or may be formed in a two-step shape using a tenting resist 42, described below (Step 3 in FIG. 5, FIG. 6C).

Next, the tenting resist 41 is removed, and then the tenting resist 42 having openings smaller than the openings of the tenting resist 41 is formed on the back side of the silicon substrate 1. The silicon substrate 1 is processed by RIE using the tenting resist 42 as a mask to form two-step through-holes 3. Furthermore, a dielectric layer (not illustrated) on the electrodes (electrically connecting parts) 17 for electrical connection is removed using the mask to expose the electrically connecting parts 17 (Step 4 in FIG. 5, FIG. 6D).

Next, the silicon substrate 1 is diced along the dicing lines 9 into chips. Thereafter, the electrical wiring member 31 formed on a mount member 43 and the electrically connecting part 17 formed on the back side are electrically connected by wire bonding using a flexible wire, such as a gold (Au) wire 7. Thereafter, the through-hole 3 is filled with the sealing member 63 covering the electrical connecting portion (Step 5 in FIG. 5, FIG. 6E). Although the position of the electrical wiring member 31 in FIG. 6E and the position of the electrical wiring member 31 in FIG. 3 differ, the electrical wiring member 31 of the present disclosure may be disposed at either position or any other position.

Second Embodiment

Figure 7A:
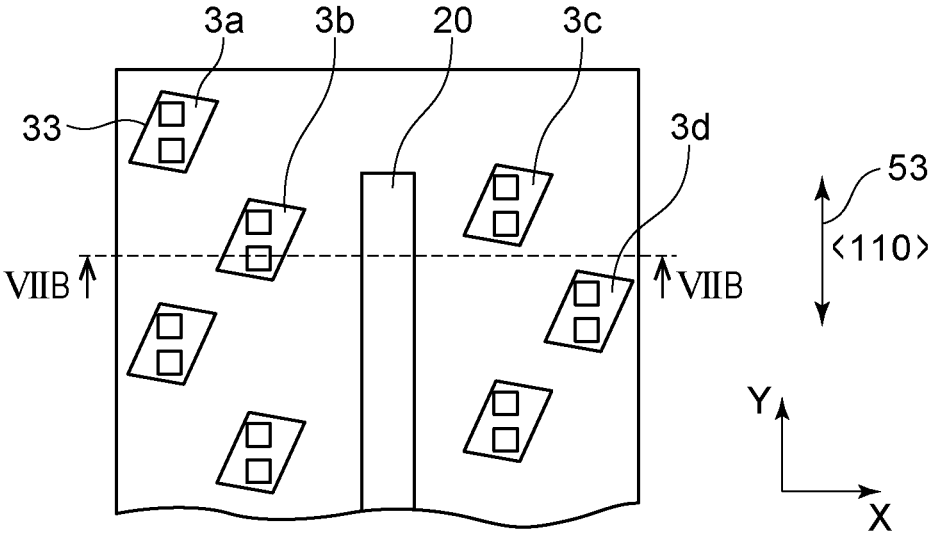
FIGS. 7A and 7B are diagrams illustrating a silicon substrate according to a second embodiment of the present disclosure.
Figure 7B:
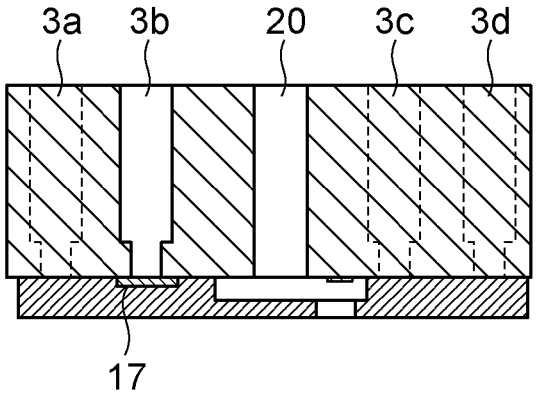

A second embodiment of the present disclosure will be described with reference to FIGS. 7A and 7B. The same or corresponding parts as those of the first embodiment are given the same reference signs, and descriptions thereof will be omitted. FIGS. 7A and 7B are diagrams illustrating a silicon substrate 1 of the second embodiment. FIG. 7A is a top view of the back side of the silicon substrate 1, and FIG. 7B is a schematic cross-sectional view taken along line VIIB-VIIB of FIG. 7A.

The difference between the present embodiment and the first embodiment is that a through-hole 3*c* and a through-hole 3*d* are formed at positions asymmetric to the first through-hole 3*a* and the second through-hole 3*b* about the liquid supply port 20. Furthermore, the first through-hole 3*a* and the second through-hole 3*b* are disposed at different position in the X-direction substantially perpendicular to the direction [110]. It is known that silicon substrates are prone to cracking in the X-direction perpendicular to the direction [110]. Accordingly, the disposition of the through-holes 3 as in the present embodiment increases the rigidity of the silicon substrate 1 also in the X-direction perpendicular to the direction [110], thereby suppressing cracking of the silicon substrate 1 in the X-direction. In other words, the present embodiment suppresses cracking of the silicon substrate 1 in the direction [110] because the outer shape of the through-hole 3 has no sides parallel to the direction [110] and also suppresses cracking of the silicon substrate 1 in the direction perpendicular to the direction [110] because the through-holes 3 are shifted in the X-direction.

Third Embodiment

A third embodiment of the present disclosure will be described with reference to FIGS. 8A and 8B. The same or corresponding parts as those of the first embodiment are given the same reference signs, and descriptions thereof will be omitted. A feature of the present embodiment is that a cover member 130 is attached to the ejection port 19 side of the liquid ejection head 100.

Figure 8A:
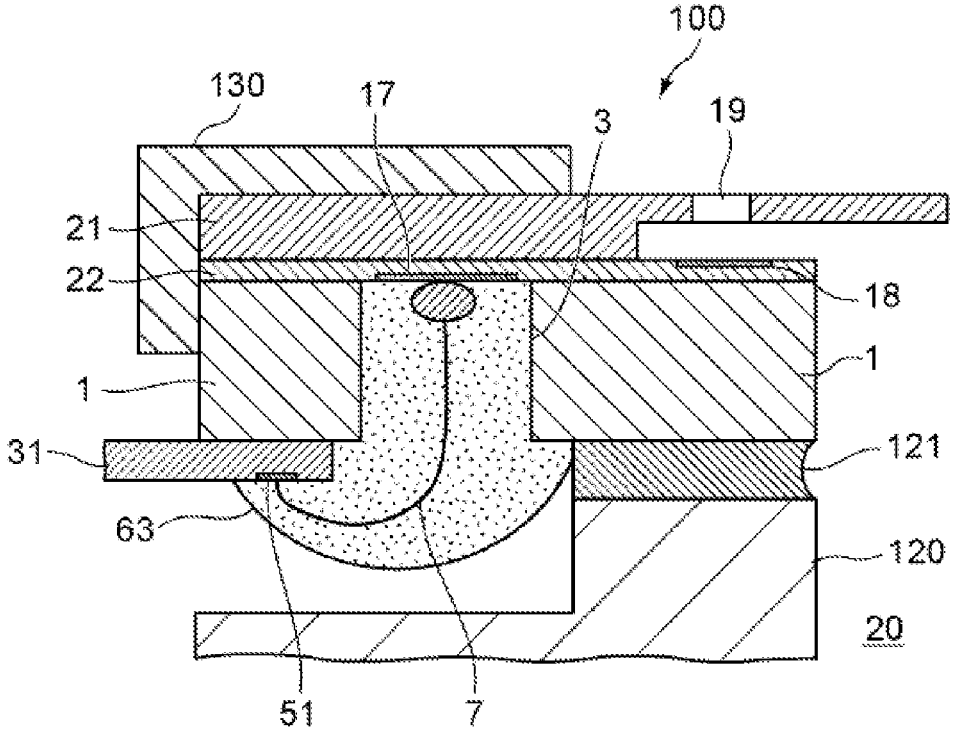
FIGS. 8A and 8B are schematic diagrams illustrating a liquid ejection head according to a third embodiment of the present disclosure.
Figure 8B:
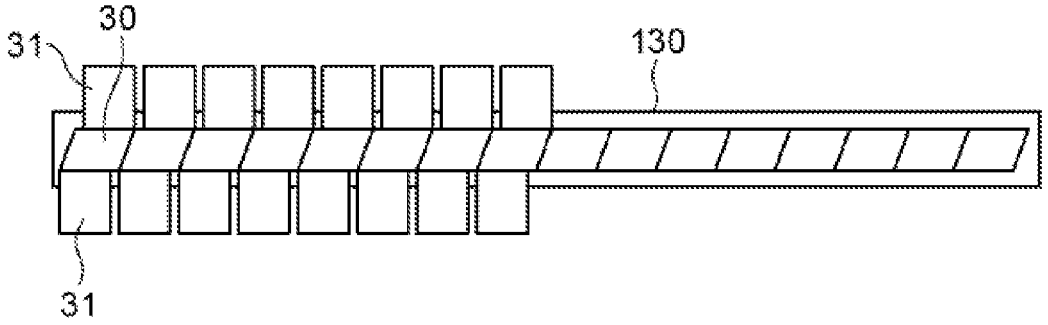

FIG. 8A is a schematic cross-sectional view of the recording element substrate 30 taken along line VIIIA-VIIIA of FIG. 2B. FIG. 8B is a schematic diagram of a plurality of recording element substrates 30 to which the cover member 130 is attached and the cover member 130 as viewed from the back side of the recording element substrate 30. As illustrated in FIG. 8B, the cover member 130 has a frame shape having an opening for exposing the recording element substrates 30. The inner surface of the frame and the recording element substrates 30 are fixed using an adhesive (not illustrated).

Since the recording element substrate 30 has the through-hole 3 on the back side, the part of the recording element substrate 30 having the through-hole 3 is thin, thus decreasing in strength, which may cause deformation or cracking of the recording element substrate 30. In FIGS. 8A and 8*b*, the cover member 130 is disposed at the position of the through-holes 3. In other words, the through-holes 3 and the frame of the cover member 130 overlap as viewed from the ejection port side. Accordingly, the present embodiment enhances the strength of the portion of the recording element substrate 30 having the through-hole 3. Examples of the material of the cover member 130 include resin, metal, and other various materials. The cover member 130 may be made of metal, such as steel use stainless (SUS). Resin may also be used. Resin that contains a filler may be used in view of strength.

Since the cover member 130 is attached to the liquid ejection head 100, a sucker (not illustrated) for use in sucking the liquid in the liquid ejection head 100 through the ejection port 19 is in close-contact with the cover member 130, which increases the suction efficiency.

Other Embodiments

Figure 9A:
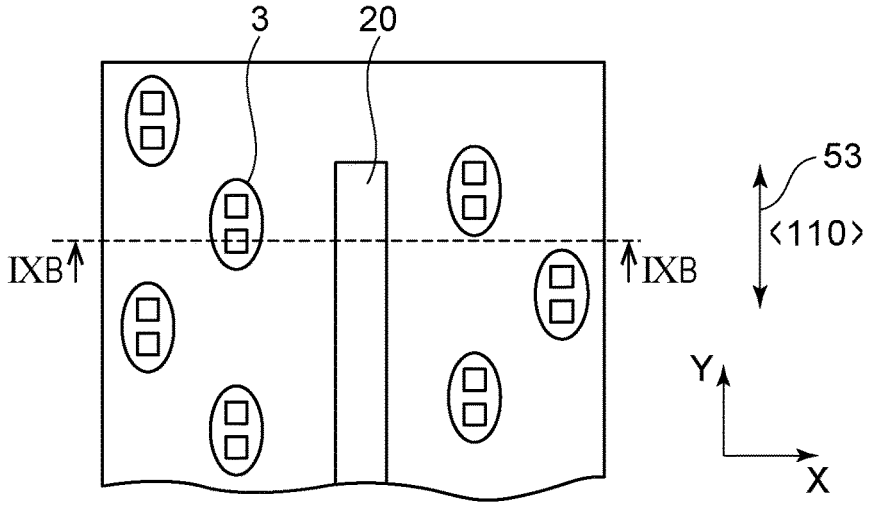
FIGS. 9A to 9C are schematic diagrams illustrating silicon substrates according to other embodiments of the present disclosure.
Figure 9B:
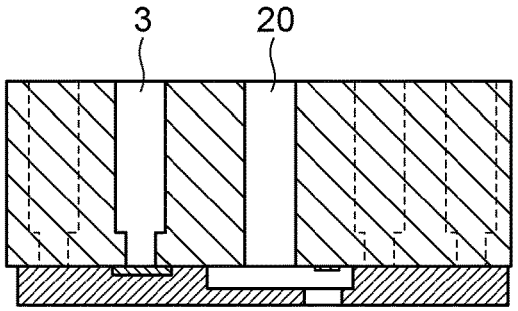
Figure 9C:
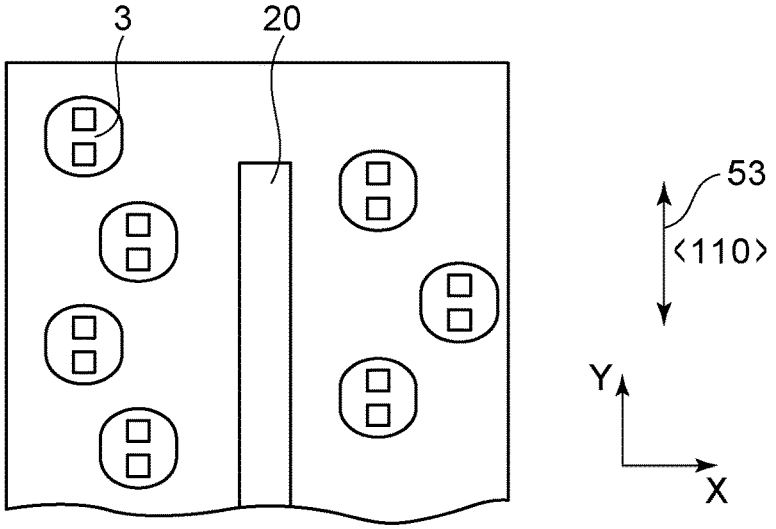

Other embodiments of the present disclosure will be described with reference to FIGS. 9A to 9C. The same or corresponding parts as those of the first embodiment are given the same reference signs, and descriptions thereof will be omitted. FIGS. 9A to 9C are schematic diagrams illustrating modifications of the opening 52 of the through-hole 3. FIG. 9A is a schematic diagram of a through-hole 3 whose outer shape is elliptical. FIG. 9B is a cross-sectional view taken along line IXB-IXB of FIG. 9A. FIG. 9C is a schematic diagram of a through-hole 3 having an outer shape including a curvature and a non-curvature.

The outer shape of the through-holes 3 illustrated in FIG. 9A has not sides parallel to the direction [110], as in the first embodiment. This suppresses cracking of the silicon substrate 1 in the direction [110]. The shape of the through-holes 3 of the present disclosure is not limited to the shapes described above. Although the outer shape of the through-holes 3 in FIG. 9A is elliptical, the outer shape may be circular. Although the outer shape of the through-holes 3 in FIG. 9C has sides parallel to the direction [110], the length of each parallel side is half or less than the entire length of the through-hole 3 in the direction [110]. Even if the outer shape of the through-hole 3 has a side parallel to the direction [110], cracking of the silicon substrate 1 in the direction [110] can be suppressed by making the length of the parallel side half or less than the entire length of the through-hole 3. In other words, even if the outer shape of the through-hole 3 has a side parallel to the direction [110], the advantageous effects of the present disclosure may be provided.

The present disclosure provides a liquid ejection head in which cracking of a recording element substrate in which a plurality of through-holes are formed on the back side is suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-197291 filed Oct. 19, 2018 and No. 2019-168862 filed Sep. 17, 2019, which are hereby incorporated by reference herein in their entirety.

What is claimed is:

1. A liquid ejection head comprising:

a recording element substrate including:

an ejection port member including an ejection port that ejects liquid, an electrical wiring layer including a pressure generating element configured to pressurize the liquid to eject the liquid and an electrically connecting part connected to the pressure generating element to supply power to the pressure generating element for driving the pressure generating element, and a silicon substrate having the ejection port member and the electrical wiring layer on a front side, wherein a back side of the silicon substrate is a surface (100), wherein the silicon substrate includes at least one through-hole passing through the silicon substrate to expose the electrically connecting part, and wherein, when the silicon substrate is viewed from a direction perpendicular to a principal surface of the silicon substrate, an outer shape of an opening of the at least one through-hole on the back side of the silicon substrate has no side parallel to a direction [110] of the silicon substrate and is a parallelogram having no side parallel to the direction [110] of the silicon substrate.

2. The liquid ejection head according to claim 1, wherein the at least one through-hole includes a first through-hole and a second through-hole adjacent to the first through-hole, and wherein the first through-hole and the second through-hole are disposed on a straight line extending in the direction [110].

3. The liquid ejection head according to claim 2, wherein the silicon substrate further includes a liquid supply port for supplying the liquid to the ejection port, and wherein the silicon substrate further includes third and fourth through-holes that expose the electrically connecting part at positions asymmetric to the first through-hole and the second through-hole with respect to the liquid supply port.

4. The liquid ejection head according to claim 1, wherein the at least one through-hole includes a first through-hole and a second through-hole adjacent to the first through-hole, and wherein the second through-hole is disposed at a position shifted from the first through-hole in a direction substantially perpendicular to the direction [110].

5. The liquid ejection head according to claim 1, wherein the at least one through-hole is disposed at an end of the silicon substrate.

6. The liquid ejection head according to claim 1, wherein the silicon substrate has a parallelogram outer shape having sides inclined with respect to the direction [110], and wherein the at least one through-hole is disposed along the inclined sides.

7. The liquid ejection head according to claim 1, wherein the pressure generating element includes a heater configured to heat the liquid.

8. The liquid ejection head according to claim 1, wherein a plurality of recording element substrates including the recording element substrate are disposed in a straight line in a longitudinal direction of the liquid ejection head.

9. The liquid ejection head according to claim 1, wherein a plurality of recording element substrates including the recording element substrate are disposed in a staggered pattern in a longitudinal direction of the liquid ejection head.

10. The liquid ejection head according to claim 1, wherein the liquid ejection head includes a PageWide liquid ejection head in which a plurality of recording element substrates including the recording element substrate are arrayed.

11. The liquid ejection head according to claim 1, further comprising a cover member attached to the liquid ejection head, wherein the at least one through-hole and a frame of the cover member overlap as viewed from the ejection port side.

12. The liquid ejection head according to claim 1, further comprising an electrical wiring member electrically connected to the electrically connecting part through a metal wire and configured to supply the power to the electrically connecting part, wherein the at least one through-hole is filled with a sealing member covering a connection between the electrically connecting part and the metal wire.

* * * * *